United States Patent [19]

Knight

[11] Patent Number: 4,723,848

[45] Date of Patent: Feb. 9, 1988

[54] FLOATING VERTICAL SHAFT DOWNFLOW DIRECTIONAL MIXER AND METHOD

[75] Inventor: James A. Knight, Pearl City, Ill.

[73] Assignee: Aqua-Aerobic Systems, Inc., Rockford, Ill.

[21] Appl. No.: 56,122

[22] Filed: Jun. 1, 1987

[51] Int. Cl.[4] ..... B01F 5/10; B01F 5/12; B01F 7/22

[52] U.S. Cl. ..... 366/270; 366/279; 366/343

[58] Field of Search ..... 366/251, 264, 249, 245, 366/247, 270, 136, 279, 343, 134, 137, 262, 266, 280; 415/52, 53 R; 417/61, 238; 261/91

[56] References Cited

U.S. PATENT DOCUMENTS

| | | | |
|---|---|---|---|
| 2,991,983 | 7/1961 | Logan . | |
| 3,856,272 | 12/1974 | Ravitts . | |
| 4,014,526 | 3/1977 | Cramer, Jr. | 366/343 |
| 4,089,620 | 5/1978 | Ravitts | 366/270 X |
| 4,378,165 | 3/1983 | Landberg | 366/270 |
| 4,422,771 | 12/1983 | Earhart . | |
| 4,459,030 | 7/1984 | Weetman | 366/262 |
| 4,571,090 | 2/1986 | Weetman et al. | 366/343 X |

FOREIGN PATENT DOCUMENTS 1428349 3/1976 United Kingdom .

*Primary Examiner*—Timothy F. Simone
*Attorney, Agent, or Firm*—Vernon J. Pillote

[57] ABSTRACT

A floating vertical shaft downflow directional mixer apparatus including a float, a motor driven propeller mounted on an upright propeller shaft below the float, and a draft tube extending downwardly from the float and having a lateral discharge outlet. The float is arranged to support the mixer with the propeller shaft generally upright when the mixer is not in operation. The draft tube and lateral discharge outlet are bilaterally symmetrical with respect to a median plane and a thrust reaction line is attached to the lower portion of the draft tube generally symmetrical to the median plane to counteract the reaction forces on the mixer produced by the stream discharged from the discharge outlet and maintain the propeller shaft generally upright when the mixer is in operation.

12 Claims, 7 Drawing Figures

35'
10
M
32
11
15
36'
31'
33'
31'
33'

11
M
10
S
33'
31'
15
32'
15d

M
32"
11
35"
10
31"
33"
15
32"
31"
33"

11
M
10
S
33"
31"
35"
15
32"
15d

FLOATING VERTICAL SHAFT DOWNFLOW DIRECTIONAL MIXER AND METHOD

BACKGROUND OF THE INVENTION

The present invention relates to an apparatus and method for mixing material including solids and gaseous materials in an open surface body of liquid.

Floating vertical shaft downflow mixers such as disclosed in U.S. Pat. Nos. 4,422,771 and 3,856,272 and U.K. Pat. No. 1,428,349 have heretofore been provided for mixing materials in an open surface body of liquid. In general, such prior floating vertical shaft downflow mixers were arranged to pump liquid from an upper inlet downwardly to an annular discharge outlet which discharged the liquid in an annular generally conical stream radially symmetrical with respect to the axis of the propeller drive shaft. Such downflow mixers produce a circulation of liquid in an annular area around the mixer, but are limited in circulating and mixing in areas remote from the mixer. It has also been proposed as disclosed in U.S. Pat. No. 2,991,983, to provide a fixedly mounted vertical shaft directional mixer in which the propeller is arranged to pump liquid downwardly through a draft tube to a lateral discharge outlet at the lower end of the draft tube and discharge the liquid in a unidirectional stream extending in a relatively narrow arc from the mixer. Concentration of the energy of the liquid discharged from the mixer into a relatively narrow arc markedly increases the distance that the stream will travel away from the mixer and improves circulation and mixing over a larger area of the basin. In the fixedly mounted mixer disclosed in that patent, the direction of the unidirectional stream can be changed by rotating the draft tube about an upright axis.

It is more convenient and practical in many installations to provide a float supported mixer. Such floating mixers are easier to install and also accommodate changes in the water level in the basin. However problems were encountered in stabilizing a floating vertical shaft directional downflow mixer. In floating vertical shaft downflow mixers, the motor is mounted on the float to extend upwardly from the float and because of the very substantial weight of the motor as compared to the other parts of the mixer, the center of gravity of floating vertical shaft downflow mixer is above the center of buoyancy of the mixer. When a directional draft tube was added to the floating vertical shaft downflow mixer, the reaction forces produced by the laterally directed stream of liquid discharged from the lateral outlet of the draft tube tended to cause the floating mixer to tilt excessively. Attempts to overcome the stability problem by providing a plurality of floats arranged so as to increase the buoyancy of the float at the side at which the draft tube discharged the water, were marginally successful but required a complicated float structure. In addition, increasing the buoyancy of the float at one side of the mixer caused the mixer to float with the propeller shaft at an angle to the vertical when the mixer was not in operation, but was also not entirely successful in stabilizing the mixer when the mixer was in operation.

SUMMARY OF THE INvENTION

It is an object of the present invention to provide a floating vertical shaft downflow directional mixer and method in which the propeller shaft remains generally vertical when the mixer is not in operation and also when the mixer is in operation.

Another object of this invention is to provide a floating vertical shaft downflow directional mixer and method in accordance with the foregoing object and in which the position and direction of discharge of the mixer apparatus in the body of water can be easily adjusted.

Accordingly, the present invention provides a floating vertical shaft downflow directional mixer comprising float means for buoyantly supporting the mixer in an open surface body of liquid, a drive motor means mounted on the float for support thereby above the surface of the body of liquid and propeller shaft means drivingly connected to the motor means and extending downwardly therefrom with propeller means on the propeller shaft at a location below the float means. A vertically elongated draft tube means is mounted on the float to extend downwardly therefrom and the draft tube means has an upper intake end and a pump casing portion extending downwardly from the intake end around the propeller, and a lower draft tube portion terminating in a lateral discharge outlet at one side of the draft tube and spaced a distance below the float. The draft tube and discharge outlet of the draft tube are generally bilaterally symmetrical to a median plane through the axis of the propeller shaft and the float is constructed and arranged to support the draft tube with propeller shaft means disposed generally vertical when the motor is not driving the propeller means. The motor is operative to drive the propeller in a direction to pump liquid downwardly through the draft tube and out through the discharge outlet means to direct liquid pumped by the propeller from one side of the draft tube in a unidirectional stream generally symmetrical to the median plane and having a substantial horizontal component. Means are provided for stabilizing the mixer apparatus against tipping due to the reaction forces produced by the stream of liquid discharged from the outlet of the draft tube, the stabilizing means including an elongated thrust reaction means, draft tube attachment means attaching one end of the thrust reaction means to the discharge portion of the draft tube means generally symmetrical to the median plane, an anchor means spaced in a direction having a major horizontal component spaced from said one side of the draft tube means for anchoring a second end of the thrust reaction means to maintain the mixer apparatus oriented with propeller shaft means generally upright when the motor drives the propeller.

The thrust reaction means may comprise a flexible line such as a cable, chain or rope attached to the lower discharge portion of the draft tube at the side adjacent the discharge outlet. When a flexible thrust reaction line is used, it is desirable to also attach one or more mooring lines or cables to the mixer to position the mixer in the body of water and to inhibit drifting of the mixer in a direction toward the thrust reaction line when the mixer is not operating. The thrust reaction means may also comprise two thrust lines attached to the discharge head at locations symmetrical to the median plane and anchored at their other ends at points spaced horizontally from the mixer and laterally from each other. The position of the mixer apparatus and the direction of the stream issuing therefrom can be changed by changing the relative lengths of the two thrust reaction lines. The thrust reaction means may also be in the form of an elongated member such as a rod that is attached at one end of the discharge head of the mixer and at its other end to the anchor means. The rod will inhibit drifting of the mixer toward the anchor means and arranged to allow the floating downflow mixer to move vertically in the basin while maintaining the propeller shaft means generally upright when the motor drives the propeller.

BRIEF DESCRIPTION OF THE DRAWINGS

The present invention relates to improvements in floating vertical shaft downflow mixer apparatus and particularly to an improvement wherein the floating vertical shaft downflow mixer is arranged to discharge a unidirectional stream in a direction laterally of the mixer, and an arrangement for stabilizing the mixer so that the vertical shaft remains substantially vertical when the floating directional mixer is in operation and also when it is not in operation. In general, the floating vertical shaft downflow mixer M includes a float means 10 for buoyantly supporting the mixer apparatus in an open surface body of water W, a drive motor 11 mounted on the float for support thereby above the surface S of the body of liquid, a propeller shaft means 12 drivingly connected to the motor and extending downwardly therefrom, and a propeller means 13 on the lower end of the propeller shaft means at a location below the float means. A vertically elongated draft tube means 15 is mounted on the float means to extend downwardly therefrom and the draft tube means has an upper intake end 15*a*, a pump casing portion 15*b* extending downwardly from the intake end around the propeller means, and a lower discharge portion 15*c* that terminates in a lateral discharge outlet 15*d*. As shown in FIG. 2, the draft tube means is supported on the float means by bars 17 that conveniently extend along the outer side of the pump casing means 15*a* and to a mounting ring 17 at the lower side of the float. In the embodiment shown, the intake end 15*a* of the draft tube means is spaced below the float means and is open around the entire periphery so that liquid can enter the intake end of the draft tube in a flow generally radially symmetrical with respect to the propeller shaft. It is to be understood, however, that the space between the intake end 15*a* of the draft tube and the float could be partially shrouded or blocked so that liquid would enter only at the side or sides that were not shrouded or blocked. The mixer construction illustrated is of the type disclosed in U.S. Pat. No. 4,422,771 issued Dec. 27, 1983 and owned by the assignee of the present invention, the disclosure of which is incorporated herein by reference. As more fully disclosed in that patent, the propeller shaft 12 is formed as an extension of the motor shaft and a shaft stabilizer tube 21 extends downwardly from the motor mount, and an anti-deflection bearing means 22 is provided between the shaft 12 and the stabilizer tube 21 to limit deflection of the shaft.

The draft tube 15 is constructed and arranged so that the pump casing portion 15*b* and the lower discharge portion 15*c* and discharge outlet 15*d* are generally bilaterally symmetrical to a median plane through the axis of the propeller shaft 12. FIG. 2 is a sectional view through the draft tube taken on the median plane of symmetry of the draft tube. In the embodiment shown, the pump casing portion 15*b* is generally cylindrical and coaxial with the propeller shaft, and the lower discharge portion 15*c* is in the form of an elbow that curves downwardly and laterally in the median plane and terminates in a discharge outlet 15*d* disposed transverse to the median plane and at one side of the draft tube. The elbow 15*c* is preferably a smooth arcuate curve to minimize turbulence while changing the direction of the stream from a downwardly flowing stream at the propeller to a laterally flowing stream at the discharge outlet. The length and angle of the draft tube are selected to effect directional mixing to the desired depth and distance from the mixer apparatus. In the embodiment shown in FIG. 2, the discharge elbow 15*c* extends through an angle of about 75° to discharge a unidirectional stream laterally and downwardly at an angle of about 15° below horizontal. In the embodiment shown in FIG. 3, the discharge elbow extends through about 45° to direct a stream laterally and downwardly at an angle of about 45° to the horizontal. As is deemed apparent, the draft tube can be made longer to locate the discharge outlet somewhat further below the surface of the body of liquid, if desired.

Figure 1:
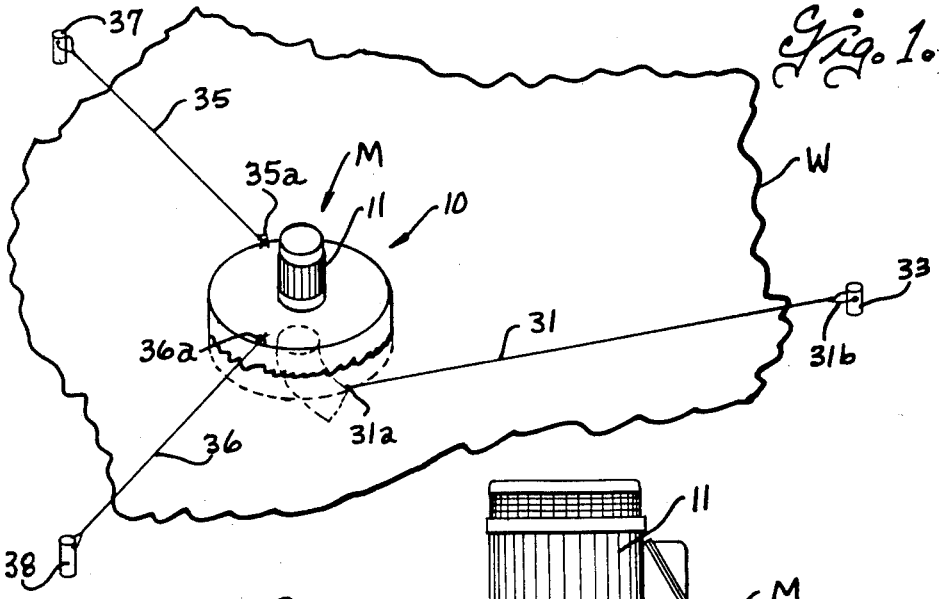
FIG. 1 is a diagrammatic perspective view illustrating a floating vertical downflow directional mixer installed in a open surface body of water.

The float 10 is constructed and arranged to support the mixer with the propeller shaft 12 generally upright when the motor is not operating to drive the propeller. In the preferred embodiment illustrated, the float 10 is in the form of an annular body generally radially symmetrical with respect to the propeller shaft 12. The float 10 has a central passage 10*a* extending downwardly therethrough to allow insertion and withdrawal of the propeller and shaft through the top of the float. As disclosed more fully in the aforementioned U.S. Pat. No. 4,422,771, the opening 10*a* is closed as by a plate 19 attached to a mounting ring 18 on the float to inhibit entrance of air therethrough, and the stabilizer tube 21 is also preferably sealed as by seal means 19*a* around the shaft 12 to inhibit entrance of air through the tube 21.

Figure 2:
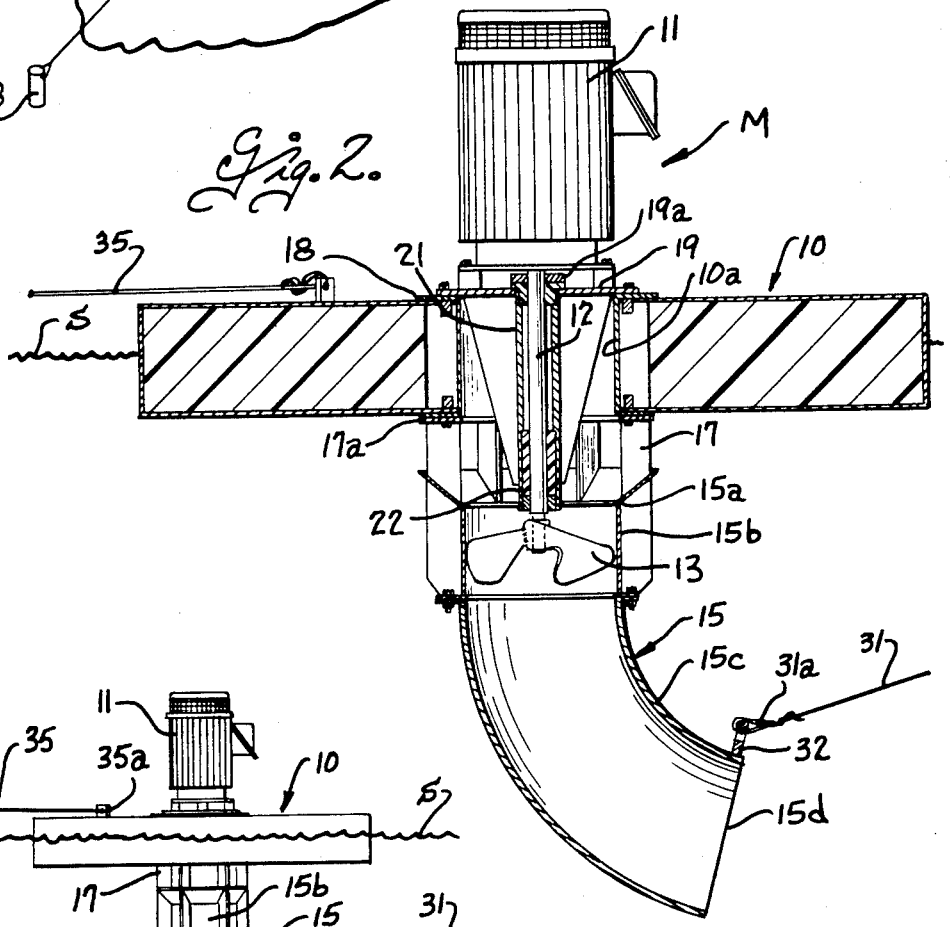
FIG. 2 is a vertical sectional view of a floating vertical downflow directional mixer.
Figure 3:
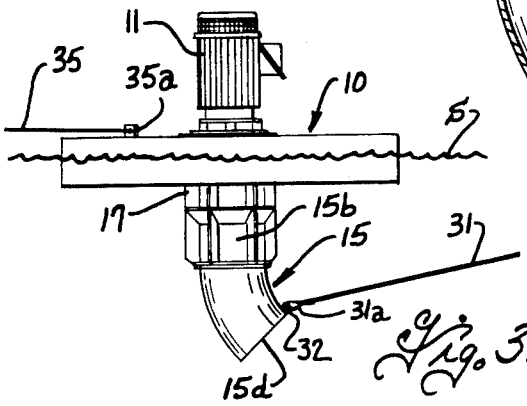
FIG. 3 is a side elevational view of a floating vertical shaft downflow directional mixer having a modified draft tube.

Means are provided for stabilizing the mixer apparatus against tipping when in operation, due to the reaction forces produced by the laterally directed stream of liquid discharged from the outlet of the draft tube means. In accordance with the present invention, the stabilizer means includes an elongated thrust reaction means 31 which is attached at one end 31*a* by attachment means 32 to the lower discharge portion of the draft tube and is anchored at its other end 31*b* to an anchor means 33. The thrust reaction means is constructed and arranged to allow vertical movement of the floating downflow mixer apparatus in the body of water while maintaining the mixer apparatus oriented with the propeller axis generally upright when the motor means operates the propeller means. The attachment means 32 is located adjacent the discharge outlet 15*d* of the draft tube so that the reaction forces on the draft tube produced by the stream of liquid discharged from the outlet 15*d* will tension the thrust reaction means 31 with a tension that substantially counteracts the reaction forces on the draft tube. Thus, the attachment means 32 is spaced below the float a distance approximating the spacing of the discharge outlet below the float and approximately the same distance from the center of buoyancy of the mixer. The anchor means 33 is spaced from the discharge side of the draft tube means a distance greater than the spacing of the attachment means below the center of buoyancy of the mixer such that the thrust reaction line 31 has a major horizontal component. The reaction forces on the mixer produced by the stream of liquid discharged from the outlet of the draft tube produces a corresponding tension in the thrust reaction line 33 which inhibits tilting of the mixer apparatus about its center of buoyancy and maintains the propeller shaft in a generally upright position when the mixer is in operation. The attachment means 32 is also preferably arranged so that it attaches the end of the thrust reaction line 31 to the lower discharge portion of the draft tube at a location horizontally offset from the propeller axis. Thus, the reaction forces on the mixer produced by the steam of liquid discharged from the outlet, will tend to shift and turn the mixer about the propeller shaft axis so that the median plane of the draft tube is symmetrical with respect to the thrust reaction line means. When a single thrust reaction line is used such as shown in FIGS. 1–3, the mixer will tend to align the median plane of the draft tube with the thrust reaction line 31.

In order to inhibit drifting of the mixer toward the anchor 33 when the mixer is not operating, and to also facilitate positioning of the mixer apparatus in the body of water W in a direction transverse to the median plane of the draft tube, mooring lines such as indicated at 35, 36 are attached as at 35*a* and 36*a* to the mixer apparatus and are otherwise anchored by stationary anchors 37, 38. The mooring lines 35, 36 are preferably arranged to extend from the mixer apparatus at an angle to the median plane of the draft tube and in a direction having a substantial component in a direction opposite the direction of the thrust reaction line 31. The mooring lines 35, 36 inhibit drifting of the mixer in a direction toward the anchor 33 when the mixer is not in operation and the position of the mixer in the body of water can be adjusted by adjusting the relative length of the lines 35, 36.

Figures 4, 5, 6, 7:
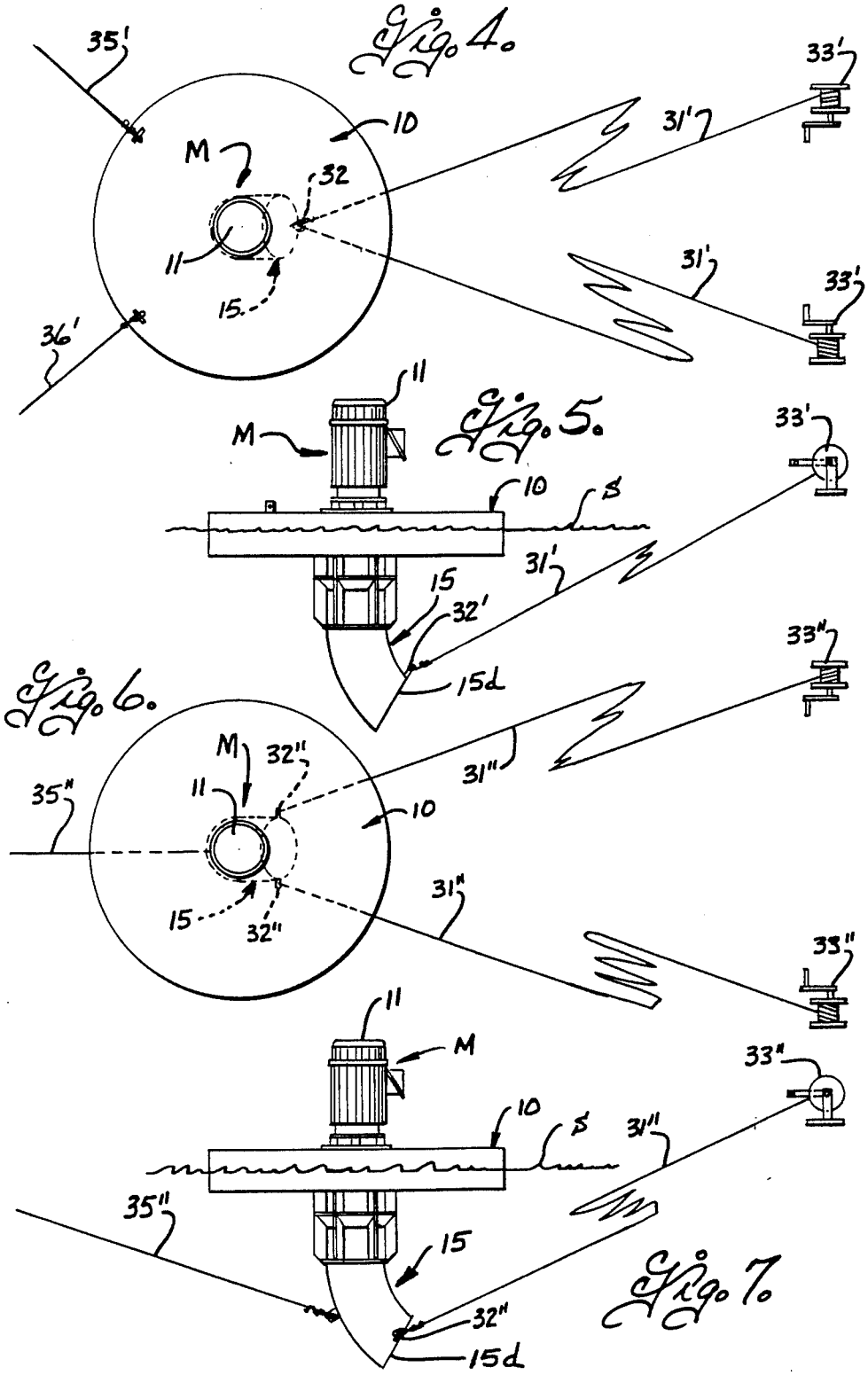
FIG. 4 is a plan view of a vertical downflow directional mixer apparatus having a modified form of thrust stabilizing means.
FIG. 5 is a side elevational view of the mixer apparatus of FIG. 4.
FIG. 6 is a diagrammatic plan view of a floating vertical shaft downflow directional mixer apparatus having another form of thrust stabilizing means.
FIG. 7 is a side elevational view of the mixer apparatus of FIG. 6.

The floating vertical shaft downflow directional mixer M can also be provided with a pair of thrust reaction lines designated 31' in FIGS. 4 and 5, and which are attached to the lower discharge portion of the draft tube by the aforementioned attachment means 32. As best shown in FIG. 4, the dual thrust reaction lines 31' are anchored to separate anchors 33' spaced from the discharge outlet and spaced from each other. The anchors 33' are preferably adjustable, and may for example be crank operated reels to facilitate adjusting the length of the thrust reaction lines 31, 31'. The attachment means 32 attaches the mooring lines to the draft tube at a location horizontally offset from the axis of the propeller shaft and, when the mixer is operating, the reaction forces on the draft tube produced by the stream discharged from the discharge outlet will tend to align the median plane of the draft tube such that the stream discharged from the mixer generally bisects the angle between the anchors 33'. Thus, the position and direction of discharge of the stream from the mixer apparatus can be adjusted by changing the relative lengths of the thrust reaction lines 31'. Mooring lines 35', 36' is advantageously attached to the mixer apparatus at a side opposite the side from which the thrust reaction lines extend, to inhibit drifting of the mixer toward the anchors 33'.

In the embodiment of FIGS. 6 and 7, dual thrust reaction lines 31'' are provided and attached to the lower discharge portion of the draft tube at two locations 32'' spaced substantially equal distances from opposite sides of the median plane of the draft tube and adjacent the discharge outlet. The dual discharge lines are shown anchored by adjustable anchors 33'' and adjustment of the position and direction of discharge of the mixer apparatus can be effected by adjusting the relative length of the dual thrust reaction lines. In this embodiment, a single mooring line 35'' is attached to the draft tube at a location in the draft tube median plane and at the side of the draft tube opposite the discharge outlet 15*d*, to inhibit drifting of the mixer toward the anchor means 33'' when the mixer is not operating.

The thrust reaction means may comprise one or more elongated flexible elements such as a cable, chain or rope capable of transmitting tension forces sufficient to counteract the horizontal thrust reaction forces on the mixer, but not compressive forces. In such applications, one or more mooring lines should be provided to inhibit drifting of the mixer toward the anchor means and to position the mixer in the body of water. The thrust reaction means may also comprise an elongated rod connected to the draft tube of the mixer and to the anchor means as previously described. The elongated rod should be selected so as to be capable of transmitting tension forces to counteract the thrust reaction forces on the mixer and sufficiently stiff to inhibit drifting of the mixer toward the anchor means. A rod that is sufficiently stiff to inhibit drifting of the mixer toward the anchor means can still have sufficient lateral flexibility to accommodate vertical movement of the mixer in the body of water. It is also contemplated that the ends of the rod could be swivelly connected to the mixer and anchor means to facilitate vertical movement of the mixer in the body of water.

From the foregoing it is thought that the construction and method of operating the floating vertical shaft downflow directional mixer will be readily understood. The float means is arranged to support the mixer with the propeller shaft generally upright when the mixer is not operating. When the mixer is in operation, the propeller pumps liquid downwardly through the draft tube and discharges the liquid in an unidirectional stream extending laterally from one side of the mixer apparatus and having a substantial horizontal component. The reaction forces on the mixer produced by the stream of liquid discharged from the lateral discharge outlet of the draft tube tend to cause the mixer to tilt. However, the reaction forces on the mixer produced by the stream of liquid discharged from the outlet of the draft tube tends to move the mixer away from the anchor means 33 until the tension in the thrust reaction line means substantially counteracts the reaction thrust on the mixer so that the propeller shaft remains generally upright when the mixer is in operation. Further, the reaction line means are attached to the draft tube at a location spaced horizontally from the axis of the propeller shaft and generally symmetrical with respect to the median planes so that the thrust reaction line means also tends to position the median plane of the draft tube generally symmetrical with respect to the thrust reaction line means. Thus, when a single thrust reaction line is used as shown in FIGS. 1–3, the median plane of the draft tube will tend to align with the anchor means 33'. When dual thrust reaction lines are used as shown in FIGS. 4–7, the median plane of the draft tube will tend to bisect the angle between the dual anchor means.

The embodiments of the invention in which an exclusive property or privilege is claimed are defined as follows:

1. A floating vertical shaft downflow directional mixer apparatus comprising; float means for buoyantly supporting the mixer apparatus in an open surface body of liquid, drive motor means mounted on the float means for support thereby above the surface of the body of liquid and propeller shaft means drivingly connected to the motor means and extending downwardly therefrom, propeller means on the propeller shaft means at a location below the float means, vertically elongated draft tube means mounted on the float means to extend downwardly therefrom, the draft tube means having an upper intake end and a pump casing portion extending downwardly from the intake end around the propeller means, the draft tube means having a lower discharge portion and terminating in a lateral discharge outlet means at one side of the draft tube means and spaced a distance below the float means, the lower discharge portion and discharge outlet means of the draft tube means being generally bilaterally symmetrical to a median plane through the axis of the propeller shaft means, said float means being constructed and arranged to support the draft tube means with said propeller shaft means disposed generally vertical when motor means is not driving the propeller means, said motor means being operative to drive the propeller means in a direction to pump liquid downwardly through draft tube means and out of said discharge outlet means to direct liquid pumped by the propeller means from said one side of the draft tube means in a unidirectional stream generally symmetrical to said median plane and having a substantial horizontal component, stabilizer means for stabilizing the mixer apparatus against tipping due to reaction forces produced by the stream of liquid discharged from the outlet of the draft tube, said stabilizer means including elongated thrust reaction means, draft tube attachment means attaching one end of said thrust reaction means to said discharge portion of said draft tube means generally symmetrical to said median plane, and anchor means spaced in a direction having at least a substantial horizontal component from said one side of the draft tube means for anchoring a second end of the thrust reaction means, said thrust reaction means being constructed and arranged to allow vertical movement of the floating downflow mixer apparatus in the body or water while maintaining the mixer apparatus oriented with the propeller shaft means generally upright when the motor means operates the propeller means.

2. A floating downflow mixer apparatus according to claim 1 wherein said float means is generally radially symmetrical to the propeller shaft means.

3. A floating downflow mixer apparatus according to claim 1 wherein draft tube attachment means is adjacent said discharge outlet means.

4. A floating downflow mixer apparatus according to claim 1 wherein said thrust reaction means comprises a single thrust reaction line attached to said draft tube means at a location in said draft tube median plane and at said one side of the draft tube means.

5. A floating downflow mixer apparatus according to claim 1 wherein said thrust reaction means comprises a single thrust reaction line attached to said draft tube means at a location in said draft tube median plane and at said one side of the draft tube means, and at least one mooring line attached to said downflow mixer apparatus at a location spaced from said median plane, and means for anchoring the other end of the mooring line to enable positioning of the downflow mixer apparatus in the body of water in a direction transverse to said median plane.

6. A floating downflow mixer apparatus according to claim 1 wherein the thrust reaction means includes at least two thrust reaction lines.

7. A floating downflow mixer apparatus according to claim 1 wherein said thrust reaction means includes at least two thrust reaction lines attached to said draft tube means at a common location in said draft tube median plane and at said one side of the draft tube means.

8. A floating downflow mixer apparatus according to claim 1 wherein said thrust reaction means includes at least two thrust reaction lines each attached to the draft tube means at locations spaced substantially equal distances from said draft tube median plane.

9. A floating downflow mixer apparatus according to claim 1 including mooring line means attached to said mixer apparatus for positioning the mixer apparatus in the body of water in a direction crosswise of said median plane and for inhibiting movement of the mixer apparatus in a direction toward said anchor means when the motor is not operating the propeller means.

10. A method of mixing in an open surface body of water comprising:

(a) providing a floating vertical shaft downflow directional mixer apparatus including float means for buoyantly supporting the mixer apparatus, drive motor means mounted on the float means for support thereby above the the surface of the body of liquid and propeller shaft means drivingly connected to the drive motor means and extending downwardly therefrom, propeller means on the propeller shaft means at a location below the float means, vertically elongated draft tube means mounted on the float means to extend downwardly therefrom and having an upper intake end and a pump casing portion extending downwardly around the propeller means and a lower discharge portion terminating in a lateral discharge outlet means at side of the draft tube means spaced below the float means, the lower discharge portion and discharge outlet of the draft tube means being generally bilaterally symmetrical to a median plane through the axis of the propeller shaft means, (b) placing the floating downflow mixer apparatus in the open surface body of water, the float means being arranged to support the draft tube means with the propeller shaft means generally vertical when the motor means is not driving the propeller means, (c) operating the drive motor means to drive the propeller means in a direction to pump liquid down through the draft tube means and out of the discharge outlet means in a unidirectional stream generally symmetrical to said median plane and having a substantial horizontal component, (d) attaching elongated thrust reaction means at one end .to said lower discharge portion of said draft tube means and generally symmetrical to said median plane, and anchoring a second end of the elongated thrust reaction means at a location spaced in a direction having at least a substantial horizontal component from said one side of the draft tube means to allow vertical movement of the floating downflow mixer apparatus while maintaining the mixer apparatus oriented with said propeller shaft means generally upright when the motor means drives the propeller means.

11. A method of mixing according to claim 10 wherein the thrust reaction means comprises a single thrust reaction line attached to the lower discharge portion of the draft tube means at a location in said medial plane, including the steps of attaching mooring line means to said mixer apparatus to extend therefrom at an angle to said median plane, and adjusting the length of the mooring lines to adjust the position and direction of discharge of the mixer apparatus in the body of water.

12. A method of mixing according to claim 10 wherein the thrust reaction means comprises two thrust reaction lines extending from said one side of the mixer apparatus, including the steps of adjusting the relative lengths of said two thrust reaction lines to adjust the position and direction of discharge of the mixer apparatus in the body of water.

* * * * *